United States Patent [19]

Takeuchi et al.

[11] Patent Number: 4,804,587

[45] Date of Patent: Feb. 14, 1989

[54] CHROMATE-TREATED ZINC-PLATED STEEL STRIP AND METHOD FOR MAKING

[75] Inventors: Yuko Takeuchi; Yuki Nakahara; Hajime Kimura; Shinobu Okano, all of Chiba, Japan

[73] Assignee: Kawasaki Steel Corporation, Kobe, Japan

[21] Appl. No.: 20,015

[22] Filed: Feb. 26, 1987

[30] Foreign Application Priority Data

May 21, 1986 [JP] Japan ..... 61-116642

[51] Int. Cl.[4] ..... B32B 15/04

[52] U.S. Cl. ..... 428/623; 428/629; 428/633; 428/659; 428/666

[58] Field of Search ..... 428/623, 629, 633, 659, 428/666, 684

[56] References Cited

U.S. PATENT DOCUMENTS

| | | | |
|---|---|---|---|
| 4,137,132 | 1/1979 | Ward et al. | 204/38 R |
| 4,437,944 | 3/1984 | Bruno et al. | 204/27 |
| 4,548,868 | 10/1985 | Yonezawa et al. | 428/626 |
| 4,659,394 | 4/1987 | Hara et al. | 428/623 |

FOREIGN PATENT DOCUMENTS

| | | | |
|---|---|---|---|
| 1621075 | 4/1971 | Fed. Rep. of Germany | 428/629 |
| 42-14050 | 8/1967 | Japan | 428/623 |
| 47-44417 | 11/1972 | Japan | 428/623 |
| 60-110896 | 6/1985 | Japan | 428/623 |
| 60-110896 | 6/1985 | Japan . | |

*Primary Examiner*—L. Dewayne Rutledge
*Assistant Examiner*—George Wyszomierski
*Attorney, Agent, or Firm*—Young & Thompson

[57] ABSTRACT

A chromate-treated steel strip comprising a chromate film on a zinc plated steel strip is improved in corrosion resistance and coating adherence by forming the chromate film of three layer structure consisting of a metallic Cr layer, a $Cr^{3+}$ oxide layer, and an outermost surface layer of $SiO_2$ and $Cr^{3+}$ oxide plus $Cr^{6+}$ oxide plus $Cr^{6+}$ oxide. The three layered chromate film is deposited on a zinc plated steel strip by effecting cathodic electrolysis in a bath containing hexavalent chromium, colloidal silica, optional alumina sol, and a fluoride, by supplying electricity at a specific current density to a controlled quantity.

4 Claims, 5 Drawing Sheets

CHROMATE-TREATED ZINC-PLATED STEEL STRIP AND METHOD FOR MAKING

BACKGROUND OF THE INVENTION

This invention relates to chromate-treated zinc-plated steel strips having high corrosion resistance without coating, good coating adherence, and firm adhesive bond to vinyl chloride and similar resins, as well as a method for making the same.

Most of currently available zinc-plated steel strips are zinc electroplated steel strips and zinc hot dipped or galvanized steel strips. Since they are not necessarily sufficient in corrosion resistance, various zinc alloy plated steel strips including Zn-Ni, Zn-Fe, and Zn-Al alloy plated ones have been developed and marketed. These advanced products may be used as such, but are often used after a chromate treatment which serves for white rust prevention and as a primary treatment for subsequent coating.

Most currently used chromate treatments are reactive chromate treatments which are applied to those products which require a white rust generating time of 24 to 100 hours in the standard salt spray test. In the reactive chromate treatments, the quantity and nature of the resulting chromate film are largely affected by the reactivity of the underlying metal. More particularly, because of their relatively high reactivity, zinc-plated steel strips can be coated with a chromate film only by dipping the strips in conventional chromate solutions having a relatively low etching power. Since zinc alloy-plated steel strips, however, are low reactive, a chromate film can not fully grow thereon in the conventional chromate solutions. Although corrosion resistance is improved by increasing the quantity of a chromate film deposited, an excessively built-up chromate film turns to be yellow due to hexavalent chromium and thus exhibits an undesirable appearance. When such thickly chromated strips are coated with paint, the adherence between the chromate film and the paint is poor.

As a high speed plating line becomes widespread, post-treatment procedures also want speeding up. In order for the reactive chromate treatment to produce a competent quantity of a uniform chromate film, continuous dipping or spraying for a certain period of time, typically 4 to 10 seconds is necessary. A common approach for accommodating with the high speed line is to increase the number of tanks to extend the reaction time.

Another class of chromate treatment including coating and electrolytic chromate treatments becomes recently available because these treatments are little affected by the reactivity of steel strips and take a short time to completion. The coating chromate treatment is applied to those products which require a corrosion resisting time of 200 hours or more in the standard salt spray test. The electrolytic chromate treatment results in more improved adherence to a coating as compared with the reactive and coating chromate treatments because the resulting chromate film consists essentially of trivalent chromium.

The coating chromate treatment is generally practiced by a method of adding colloidal silica as a film forming agent as disclosed in Japanese Patent Publication No. 42-14050. Another method for conducting the coating chromate treatment involves applying a chromate solution containing an organic polymer by roll coating or dipping and roll squeezing, followed by drying with or without water rinsing. The coating chromate treatment, however, has the disadvantages that it is difficult to control the quantity of a chromate film deposited and that a high speed treatment frequently invites inconsistencies because the chromate film tends to be nonuniform in a transverse direction to the feed direction. It is needed to develop a technique enabling uniform film formation. Another disadvantage is that the resulting chromate film has poor adherence to a coating because the film is thick and retains hexavalent chromium unchanged throughout the film. Also, the chromate film provides a poor adhesive bond to vinyl chloride and similar resins.

The electrolytic chromate treatment is by subjecting a steel strip to cathodic electrolysis whereby hexavalent chromium is electrically reduced to trivalent chromium to form a hydrated oxide film at the strip surface. The electrolytic chromate treatment can not only readily accommodate with speeding-up because the quantity of a chromate film can be controlled by a quantity of electricity, but also be applied to various types of steel strips because hexavalent chromium ions in the chromate solution are reduced electrically rather than by redox reaction. The chromate film resulting from the electrolytic chromate treatment consists essentially of trivalent chromium and has higher coating adherence as compared with the reactive and coating chromate treatments, but is less corrosion resistant as compared with the reactive chromate treatment.

One prior art method for carrying out an electrolytic chromate treatment is disclosed in Japanese Patent Publication No. 47-44417 which is incorporated herein by reference. This method is successful in forming a good, but thin chromate film only at a relatively low current density. The chromate layer cannot be further grown even by increasing electricity quantity. Differently stated, the method fails to form a thick chromate film on a zinc alloy plated steel strip. As previously indicated, in general, the electrolytic chromate film is less corrosion resistant as compared with the reactive and coating type chromate films having the same amount of chromium deposited. This is probably because the electrolytic chromate film tends to be porous due to evolution of hydrogen gas during film formation and because the chromate film composed mainly of trivalent chromium contains an insufficient amount of hexavalent chromium to seal such pores or defects, that is, lacks a self-healing ability.

Another method for carrying out an electrolytic chromate treatment is disclosed in Japanese Patent Application Kokai No. 60-110896 which is incorporated herein by reference. A chromate film is formed in a bath containing hexavalent chromium ($Cr^{6+}$)+cationic colloidal silica+$H_2SO_4$ +optional NaOH for pH adjustment. Due to the inclusion of sulfate residues in the bath, metallic Cr tends to deposit in a chromate film particularly at a high current density and thus, the chromate film often becomes black colored. The cationic colloidal silica and sulfate residues serve as film forming agents while processing inconsistencies often occur. An observation of chromate films under a scanning electron microscope has indicated that chromate films resulting from a bath containing a fluoride additive are more uniform and dense than those from a bath containing sulfuric acid.

SUMMARY OF THE INVENTION

Therefore, an object of the present invention is to provide a novel and improved chromate-treated zinc alloy-plated steel strip having a chromate film exhibiting high corrosion resistance, good adherence to a coating, and a firm adhesive bond to vinyl chloride and similar resins.

Another object of the present invention is to provide a method for making the same wherein an electrolytic chromate treatment can be carried out on any types of zinc alloy plating within a short time to a sufficient thickness of chromate film to meet the intended application.

In the initial of developing a zinc or zinc alloy electroplated steel strip having a chromate film exhibiting satisfactory corrosion resistance, coating adherence, and adhesive bond, we attempted to carry out a coating adherence improving treatment on a reactive chromate film. This attempt, however, requires two treatments. It also requires a choice between thick and thin films. A thick film must be formed to insure corrosion resistance when it is intended to use the final product without coating. A thin film will suffice when the final product is coated on use. A compromise is to form a chromate film of moderate thickness having a minimized content of hexavalent chromium in the outermost surface layer.

Intending to produce a chromate film fulfilling the requirements of corrosion resistance, coating adherence, and adhesive bond by only an electrolytic chromate treatment, we have discovered that the object can be attained by controlling the composition of a chromate film.

More particularly, it is desired that the outermost surface region or layer of a chromate film have an effective composition to provide corrosion resistance and coating adherence.

We have discovered it effective in enhancing corrosion resistance that (1) an appropriate amount of hexavalent chromium is contained in the chromate film predominantly comprising trivalent chromium to impart a self-sealing or self-healing ability, (2) the film thickness is increased to form a reinforced barrier by adding a film forming agent such as silicon dioxide, and (3) the film is rendered uniform by adding an etching agent.

We have also discovered it effective in enhancing coating adherence that (4) the outermost surface layer is a thin region composed predominantly of trivalent chromate. (5) $SiO_2$ is effective in enhancing coating adherence, but tends to cause delamination in the chromate film as the film becomes thick. It will be advantageous that the chromate film be bonded to a resin laminated board with an adhesive. We have discovered that (6) the adhesive bond can be improved by adding $Al_2O_3$ to the chromate bath along with $SiO_2$. The present invention is predicated on these findings.

According to a first aspect of the present invention, there is provided a chromate-treated zinc-plated steel strip comprising a steel substrate, a zinc base plating on at least one surface of the substrate, a metallic chromium layer on the zinc base plating, a chromium oxide layer on the metallic chromium layer, consisting essentially of the oxide of trivalent chromium, and an outermost surface layer on the chromium oxide layer, consisting essentially of silicon dioxide and oxides of a major proportion of trivalent chromium and an effective proportion of hexavalent chromium and hydrates thereof.

According to a second aspect of the present invention, there is provided a method for preparing a chromate-treated zinc-plated steel strip, comprising effecting cathodic electrolysis on a zinc-plated steel strip in a bath containing 2.6 to 78 grams per liter of hexavalent chromium, 0.5 to 50 grams per liter, calculated as $SiO_2$, of colloidal silica, and 0.05 to 5.0 grams per liter, calculated as F, of a fluoride, at a current density of 1 to 50 $A/dm^2$ and to an electricity quantity of 5 to 100 $C/dm^2$.

In one preferred embodiment of the present invention, the outermost surface layer further contains aluminum oxide. In this case, the electrolytic chromate bath used in preparing a corresponding chromate-treated zinc-plated steel strip further contains 0.05 to 25 grams per liter, calculated as $Al_2O_3$, of alumina sol in addition to the above-defined ingredients.

BRIEF DESCRIPTION OF THE DRAWINGS

The above and other objects, features, and advantages of the present invention will be readily understood by reading the following description when taken in conjunction with the accompanying drawings, in which.

DETAILED DESCRIPTION OF THE INVENTION

Figure 1:
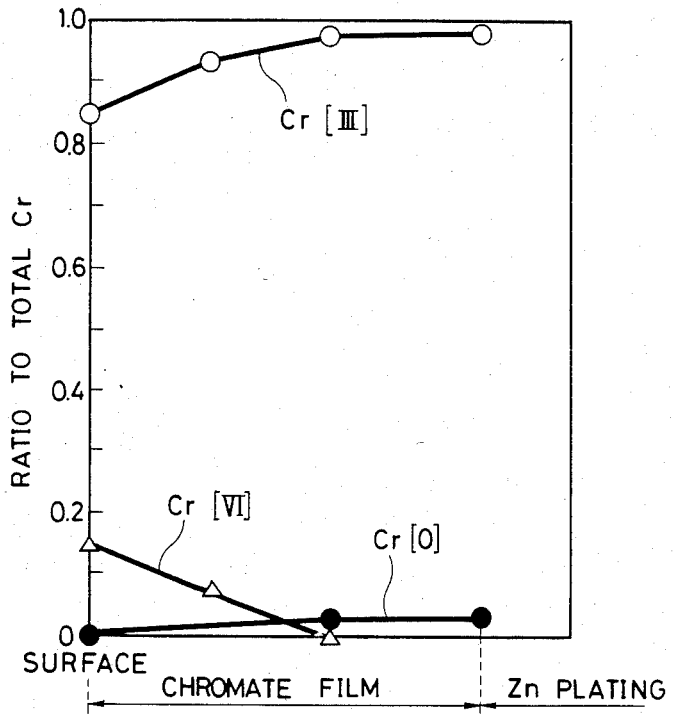
FIG. 1 is a diagram showing the proportions of metallic Cr, $Cr^{3+}$, and $Cr^{6+}$ in the chromate film analyzed by ESCA.

In the present disclosure, the term zinc plated steel strips is used to encompass steel strips plated with zinc and zinc based alloys. Typical examples of the zinc plated steel strips include zinc electroplated (or electrogalvanized), zinc hot dipped (or galvanized), galvannealed, Zn-Ni alloy plated, Zn-Fe alloy plated, and Zn-Al alloy plated steel strips. These plating surfaces are different in metal or alloy phase and particularly in reactivity during a subsequent treatment, for example, a heat treatment to form an oxide coating.

According to the present invention, electrolysis is effected on various zinc-plated steel strips in a chromate bath with the strips made cathode, by supplying constant current. Hexavalent chromium ions typically present in the form of $Cr_2O_7^{2-}$ and $CrO_4^{2-}$ in the bath are electrochemically reduced to trivalent chromium ions to form a chromate film predominantly comprising $Cr^{3+}$. Thus the formation of chromate film is little affected by the underlying layer, that is, zinc plating. The amount of chromate film formed is proportional to a quantity of electricity supplied so that the thickness of chromate film may be controlled over a wide range from thin to thick films depending on the intended application of the chromated strip.

The chromate-treated, zinc-plated steel strip according to the present invention has a chromate film consisting of (1) a layer most adjacent to the zinc base plating which consists of metallic chromium, (2) an intermediate layer which consists essentially of the oxide of trivalent chromium, and (3) an outermost surface layer which consists essentially of silicon dioxide ($SiO_2$), optional aluminum oxide ($Al_2O_3$), and oxides of a major proportion of trivalent chromium and an effective proportion of hexavalent chromium and hydrates thereof.

The metallic chromium layer disposed in direct contact with the zinc base plating is not critical in the practice of the present invention, but is naturally deposited in a small amount from the chromate bath operated under the electrolytic conditions according to the present invention. The metallic chromium layer may be discontinuous. Excess deposition of metallic chromium is undesirable because the amount of subsequently formed hydrated oxides is reduced. The weight of metallic chromium deposited is preferably limited to the maximum of 20 mg/m$^2$.

In the outermost surface layer, trivalent chromium and an effective proportion of hexavalent chromium coexist. The effective proportion of hexavalent chromium means a sufficient amount of hexavalent chromium to exert a full self-healing effect. The proportion of hexavalent chromium preferably ranges from 1/100 to 1/5 of the total weight of chromium in the chromate film. The lower limit of hexavalent chromium is set to 1/100 or 1% below which there is too little hexavalent chromium to provide a self-healing effect, failing to improve corrosion resistance. The presence of hexavalent chromium in excess of 1/5 or 20% of the total weight of chromium will result in a colored film and detract from coating adherence.

FIG. 1 shows the proportions of metallic, trivalent and hexavalent chromiums based on the total weight of chromium in the chromate film according to the present invention. The proportions of Cr(0), Cr(III) and Cr(VI) are determined in a thickness direction of the film by electron spectroscopy for chemical analysis (ESCA) and expressed as their ratio to the total chromium.

The chromate film is preferably deposited to a weight of 20 to 200 mg/m$^2$ calculated as Cr. A chromate film having less than 20 mg/m$^2$ of Cr exhibits poor corrosion resistance without coating as demonstrated by the white rust generating time of about 24 hours in the standard salt spray test (SST). Conversely, a chromate film having more than 200 mg/m$^2$ of Cr exhibits yellow color in appearance and poor coating adherence.

Figure 2:
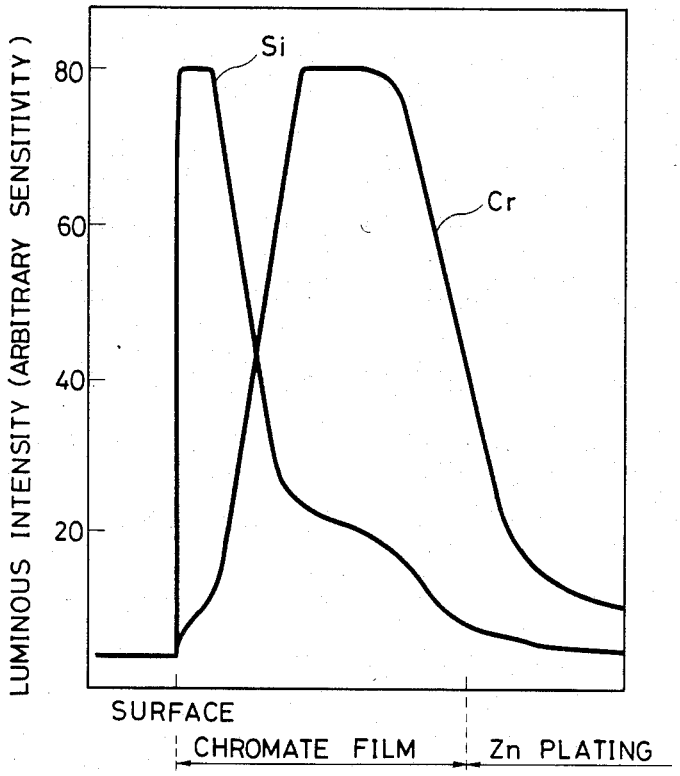
FIG. 2 is a diagram showing the relative proportions of Si and Cr in the chromate film analyzed by GDS.

According to the present invention, the chromate film contains silicon dioxide ($SiO_2$). The present invention is characterized in that silicon dioxide is preferentially present in the outermost surface layer. FIG. 2 illustrates the results of measurement of the chromate film by glow discharge spectrometry (GDS). The proportion of $SiO_2$ preferably ranges from 1/40 to ½ of the total weight of chromium in the chromate film. Less than 1/40 of the total chromium weight of $SiO_2$ is insuffient to exert its essential effect of film formation. The content of $SiO_2$ is limited by such processing factors as transfer to rolls during manufacturing process. The presence of more than ½ of the total chromium weight of $SiO_2$ results in a rather thick film and adversely affects coating adherence.

In one preferred embodiment of the present invention, the chromate film further contains aluminum oxide ($Al_2O_3$) in its outermost surface layer. Aluminum oxide is introduced to enhance coating adherence and particularly, adhesive bond characteristics. The amount of $Al_2O_3$ preferably ranges from 1/10 to ½ of the weight of $SiO_2$. Inclusion of $Al_2O_3$ in amounts of less than 1/10 of the $SiO_2$ content could not attain its own purpose of enhancing coating adherence whereas more than ½ of the $SiO_2$ content of $Al_2O_3$ renders the adsorption of $SiO_2$ to the plating surface less uniform.

It has been found that when aluminum oxide is contained in the chromate film along with silicon dioxide, the aluminum oxide contributes to significant improvements in corrosion resistance, coating adherence, and adhesive bond. Although the reason is not fully understood and the present invention is not bound to any theory, we suppose the following mechanisms. In general, alumina sol is positively charged in an acidic bath. Thus alumina is uniformly deposited on the cathode to form a rigid film during cathodic electrolysis of a steel strip. Furthermore, active hydroxyl groups on alumina colloid surface will form a firm hydrogen bond with functional groups of a subsequently applied coating or adhesive.

In summary, the chromate film of the chromate-treated zinc-plated steel strip according to the present invention has the following composition:

| | | |
|---|---|---|
| Cr | | 20–200 mg/m$^2$, |
| precisely, | $Cr^0$ | 0–20 mg/m$^2$, |
| | $Cr^{6+}$ | 0.2–40 mg/m$^2$, |
| | $Cr^{3+}$ | balance, |
| $SiO_2$ | | 0.5–100 mg/m$^2$, and optionally, |
| $Al_2O_3$ | | 0.05–50 mg/m$^2$. |

The chromate-treated, zinc-plated steel strips organized as above according to the present invention may be manufactured as follows.

In the chromate bath, first of all, hexavalent chromium is necessary as a main component for forming a chromate film. A source of $Cr^{6+}$ may be selected from $CrO_3$, chromate salts, and bichromate salts although the most common source is $CrO_3$. In a bath containing $CrO_3$ alone, electrolysis will grow little hydrated oxide, resulting in an extremely thin chromate film. This is because in a very initial stage of electrolysis, a hydrated oxide film covers the surface to retard electrolysis. In order to break thin portions of the hydrated oxide film to enable further growth of the film, an amount of etching agent is needed. A common practice is to use sulfate ion (see Japanese Patent Publication No. 47-44417) and fluoride ion. Sulfate ion tends to help metallic chromium to deposit to blacken the film when the Cr03 concentration or the current density is high.

Therefore, the present method favors the use of a fluoride as the etching agent. Typical examples of the fluorides include sodium (Na) and potassium (K) salts of $AlF_6^{3-}$, $SiF_6^{2-}$, $BF_4^-$ and $F^-$. They may be added alone or in admixture as long as a necessary level of fluoride ion is reached.

The concentration of $Cr^{6+}$ is limited to the range of 2.6 to 78 grams per liter of the solution. Concentrations of less than 2.6 g/l furnish insufficient hexavalent chromium to the plating interface to form a sound film. Concentrations of more than 78 g/l not only tend to help metallic chromium to deposit so that the hydrated oxide film becomes thin, but also invite zinc dissolution reaction at the same time so that the film becomes yellowish brown and unacceptable in appearance.

The fluoride is added to provide a concentration in the range of 0.05 to 5.0 grams of fluorine (F) per liter of the solution. Less than 0.05 g/l of F is less aggressive and fails to grow the film. More than 5.0 g/l of F has a too high etching ability and thus causes to dissolve the hydrated oxide film itself or etch the surface of the plating to give rise to zinc dissolution, resulting in complicated reaction.

The chromate bath containing only $Cr^{6+}$ and a fluoride yields a chromate film which is still thin and less resistant against corrosion. The film cannot be further grown simply by increasing the electricity quantity.

According to the present invention, colloidal silica is added as the third component to the chromate bath. Colloidal silica or $SiO_2$ sol is added as a film forming agent at a concentration of 0.5 to 50 grams of $SiO_2$ per liter of the solution. Because of its adsorption power and steric structure, colloidal silica is effective in producing a thick chromate film. Examples of the colloidal silica include anionic colloidal silica commercially available as Snowtex O and C (trademarks) and cationic colloidal silica commercially available as Snowtex AK and BK (trademarks), all manufactured by Nissan Chemical K.K. Particularly, cationic colloidal silica is preferred because the transfer of colloidal silica to the plating surface which is made cathode is promoted. In addition, cationic colloidal silica having adsorbed on its surface such anions as $Cr_2O_7^{2-}$ and $CrO_4^{2-}$ in the chromate solution is adsorbed to the cathode so that the resulting chromate film is a fully corrosionresistant film containing a self-healing amount of the hexavalent chromium component.

The amount of colloidal silica added is limited to the range of 0.5 to 50 grams of $SiO_2$ per liter of the solution. Less than 0.5 g/l is little effective. Inclusion of colloidal silica in excess of 50 g/l of $SiO_2$ results in a chromate bath having a low electric conductivity and a too thick chromate film which is unacceptably colored or nonuniform in thickness.

According to the preferred aspect of the present invention, alumina sol is added to the electrolytic chromate solution along with colloidal silica for the purpose of improving the bond of the chromated steel strip to a vinyl chloride or similar resin sheet with the aid of an adhesive. Alumina or $Al_2O_3$ sol is added in a proportion of 1/10 to ½ of the weight of $SiO_2$, that is, in a concentration of 0.05 to 25 grams of $Al_2O_3$ per liter of the solution. Less than 1/10 of the $SiO_2$ content of $Al_2O_3$ cannot attain the purpose of enhancing the adhesive bondability whereas more than ½ of the $SiO_2$ content of $Al_2O_3$ will disturb the adsorption of $SiO_2$ to the plating surface.

In the practice of the present invention, silica and alumina may be added to the electrolytic chromate solution in the following two ways.

(1) $SiO_2$ sol and $Al_2O_3$ sol are separately added in appropriate amounts.

(2) $SiO_2$ having $Al_2O_3$ sol adsorbed thereon is added in an appropriate amount.

In either of (1) and (2), the electrolytic chromate treatment can be carried out in an acceptable manner. The addition of $SiO_2$ having $Al_2O_3$ sol adsorbed thereon (2) is more advantageous in controlling the colloid sol content of the chromate film.

The above-formulated chromate bath is preferably operated at a temperature of 30° to 60° C. using an insoluble anode such as a Pb-Sn (Sn 5%) electrode as the anode. The bath is operated by supplying electricity at a current density of 1 to 50 A/dm$^2$ (ampere per square decimeter) although the exact density depends on the processing time required. Within this current density range, the amount of chromate film deposited is increased with the quantity of electricity supplied. By controlling current density and electricity quantity in accordance with the line speed associated with the chromate treatment, any desired amount of chromate film can be deposited.

The electricity quantity preferably ranges from 5 to 100 C/dm$^2$ (coulomb per square decimeter). An electricity quantity of less than 5 C/dm$^2$ is insufficient to form a chromate film beyond 20 mg/m$^2$ whereas an electricity quantity of more than 100 C/dm$^2$ will result in a chromate film beyond 200 mg/m$^2$.

After the electrolytic chromate treatment, the steel strip is roll squeezed for film thickness control and then dried, or washed with flowing water, roll squeezed for film thickness control and then dried. The former procedure is employed when corrosion resistance is important. Generally, the latter procedure involving washing is useful to present a film having a uniform appearance free of processing variations.

The present invention is distinguishable over the prior art method disclosed in Japanese Patent Application Kokai No. 60-110896 using a bath containing hexavalent chromium, cationic colloidal silica, sulfuric acid, and optional sodium hydroxide. As demonstrated in Example 4 and FIG. 7, samples treated in a bath containing $CrO_3$ + colloidal silica + fluoride according to the present invention exhibit evidently superior corrosion resistance to those treated in a bath containing $CrO_3$ + cationic colloidal silica + $H_2SO_4$ according to the prior art, provided that the amount of chromate film deposited is equal. It is supposed that while colloidal silica acts as a film forming agent, the fluoride removes an oxide coating on the plating surface to allow hydrated chromium oxides to uniformly adhere thereto and at the same time, etches away thin weak portions or readily dissolvable portions of the chromate film itself to allow a new film to grow in these sites. In the chromate bath according to the present invention, the double actions of film formation and etching occur in a well-balanced harmony so as to produce a uniform corrosion resistant film.

Although it will occur to add other anions to the bath, they have some problems. More particularly, chloride ion will color the chromate film in yellowish brown. Phosphate ion will react with the zinc plating so that a substantial amount of phosphate residue is introduced in the chromate film. Thus, corrosion resistance is less improved irrespective of the amount of chromate film deposited.

As previously indicated, among the anionic and cationic colloidal silicas, the latter is more readily adsorbed to the zinc plating surface because the zinc plated strip is made cathode during electrolytic chromate treatment. Cationic colloidal silica is thus effective even in a relatively low concentration, say 0.5 to 10 g/l of $SiO_2$. Conversely, anionic colloidal silica is used in a relatively high concentration, say 10 to 30 g/l of $SiO_2$ to obtain a satisfactory result.

As described above, the chromate film obtained from the prior art bath of hexavalent chromium, cationic colloidal silica, and sulfuric acid is rather irregular and exhibits poor corrosion resistance unless its thickness is increased to a level corresponding to an electricity quantity of more than 30 C/dm$^2$. By virtue of the fluoride, the chromate bath of the present invention can produce a dense chromate film having an aesthetic uniform appearance and high corrosion resistance even with a reduced thickness corresponding to an electricity quantity of less than 30 C/dm$^2$ and irrespective of whether the bath uses either cationic or anionic colloidal silica.

EXAMPLES

In order that those skilled in the art will readily understand the practice of the present invention, examples are given below by way of illustration and not by way of limitation. In the examples, g/l is gram per liter of solution, g/m$^2$ or mg/m$^2$ is gram or milligram per square meter of surface, A/dm$^2$ is ampere per square decimeter, add C/dm$^2$ is coulomb per square decimeter.

EXAMPLE 1

Figure 3:
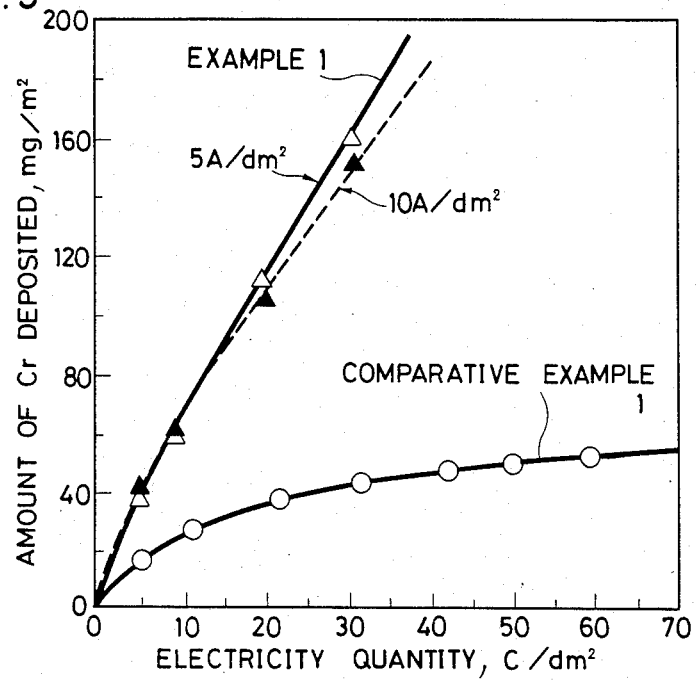
FIG. 3 is a diagram showing the weight of chromium deposited as a function of electricity quantity in the chromate treatment of Example 1.

The zinc plated steel strip used in this example was a zinc electroplated steel strip having a zinc coating weight of 20 g/m$^2$. It was subjected to a chromate treatment in a bath containing 50 g/l of $CrO_3$, 0.27 g/l calculated as F of $Na_3AlF_6$, and 3 g/l calculated as $SiO_2$ of Snowtex AK (trademark, manufactured by Nissan Chemical K.K.) in water while the quantity of electricity supplied across the strip was varied. The bath temperature was 50° C. and the current density was set to 5 A/dm$^2$ and 10 A/dm$^2$. In Comparative Example 1, a chromate treatment was effected in a bath containing 50 g/l of $CrO_3$ and 0.27 g/l calculated as F of $Na_3AlF_6$ in water under the same conditions as described above. The results are shown in FIG. 3.

In the conventional bath free of colloidal silica (Comparative Example 1), the amount of chromium deposited is only slightly increased by increasing the electricity quantity. In the bath according to the present invention (Example 1), the amount of chromium deposited is increased in approximate direct proportion to the electricity quantity. If it is desired to form a thick chromate film having a chromium weight of approximately 100 mg/m$^2$, the chromate treatment according to the present invention can produce the film by supplying electricity at a current density of 5 A/dm$^2$ to a quantity of 15 C/dm$^2$, that is, within 3 seconds. To match with a high speed plating line, approximately the same weight of chromium can be deposited by supplying electricity at 10 A/dm$^2$ to the same quantity of 15 C/dm$^2$, that is, within 1.5 seconds.

EXAMPLE 2

Figure 4:
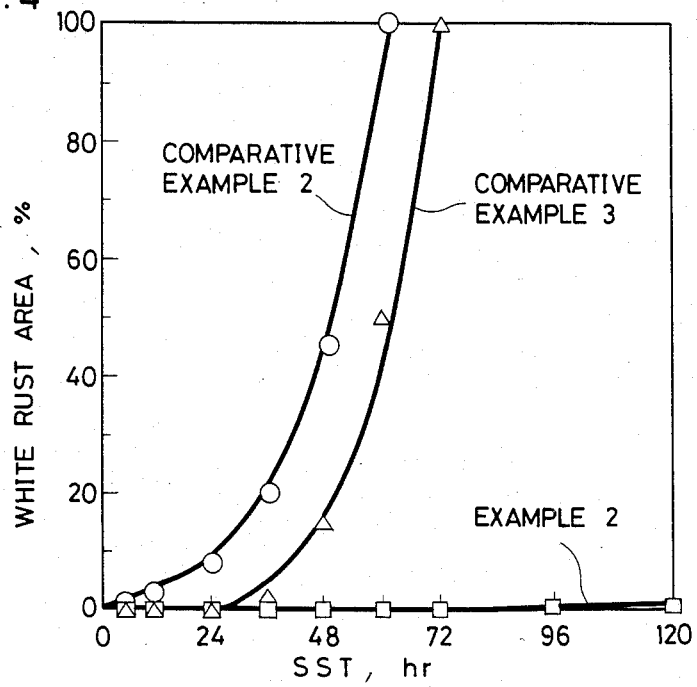
FIG. 4 is a diagram showing the percent white rust of chromate treated steel strips produced in Example 2 and Comparative Examples 2 and 3 as a function of salt spray test time.

A sample was prepared by effecting a chromate treatment on a zinc plated steel strip in a bath containing 30 g/l of $CrO_3$, 1.0 g/l calculated as F of $K_2SiF_6$, and 10 g/l calculated as $SiO_2$ of Snowtex 0 (trademark, manufactured by Nissan Chemical K.K.) in water by supplying electricity at a current density of 10 A/dm$^2$ to a quantity of 10 C/dm$^2$. The sample was subjected to a salt spray test (SST) according to JIS Z 2371 to determine the variation of percent white rust area with time. In Comparative Example 2, a chromate treatment was effected in a bath containing 30 g/l of $CrO_3$ and 10 g/l calculated as $SiO_2$ of Snowtex 0 in water under the same conditions as described above. In Comparative Example 3, a chromate treatment was effected in a bath containing 30 g/l of $CrO_3$ and 1.0 g/l calculated as F of $K_2SiF_6$ in water under the same conditions as described above. The comparative samples were also examined for corrosion resistance. The results are shown in FIG. 4 in which the percent white rust area is plotted as a function of the time of SST.

The present sample treated in the three-component bath had a satisfactory chromate film which experienced no white rust even after 90 hours of SST. The treating time of the present sample was 1 second, indicating the possible matching with a high speed line.

EXAMPLE 3

Figure 5:
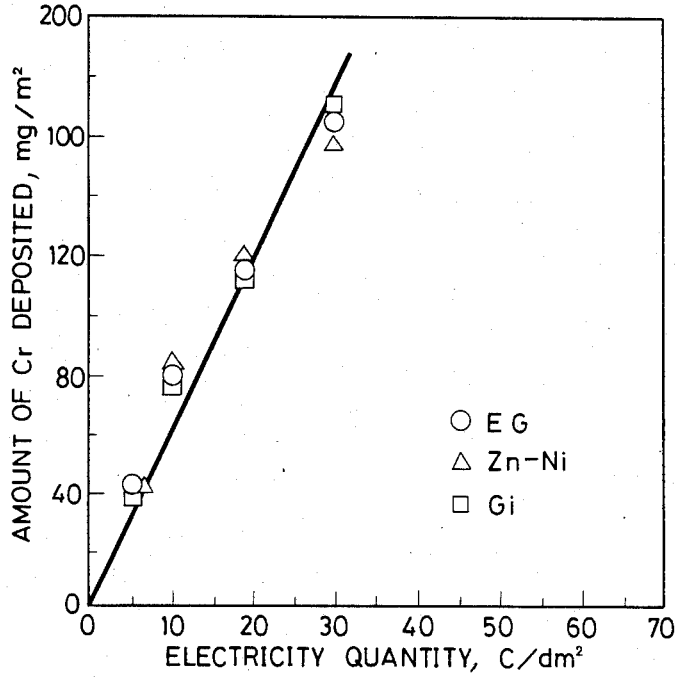
FIGS. 5 and 6 graphically show the weight of chromium deposited as a function of electricity quantity in the chromate treatment of various zinc-plated steel strips in different baths in Example 3.
Figure 6:
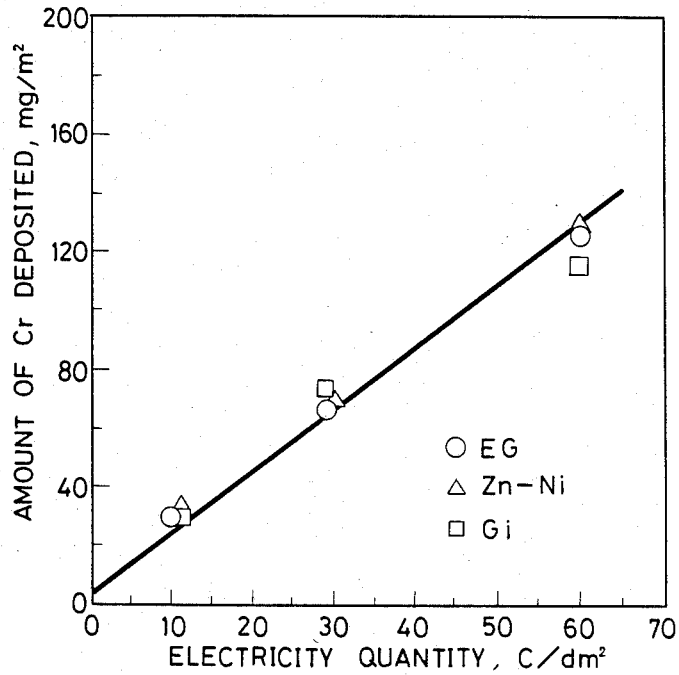

Different types of zinc plated steel strips including galvanized, electrogalvanized, and Zn-Ni plated ones were chromate treated according to the present method. The results are shown in FIGS. 5 and 6 in which the weight of chromium deposited is plotted as a function of electricity quantity. In the graphs, EG corresponds to an electrogalvanized (or zinc electroplated) steel strip having a coating weight of 20 g/m$^2$, Zn-Ni corresponds to a Zn-Ni alloy plated steel strip having a coating weight of 20 g/m$^2$ and a nickel content of 13% by weight, and GI corresponds to a galvanized (or zinc hot dipped) steel strip having a coating weight of 60 g/m$^2$. It is evident that an equal amount of chromate film is formed on different zinc plated steel strips regardless of their zinc plating type.

In FIG. 5, the strips were treated in a bath containing 50 g/l of $CrO_3$, 0.30 g/l calculated as F of $Na_2SiF_6$, and 10 g/l calculated as $SiO_2$ of Snowtex 0 in water by supplying electricity at a current density of 10 A/dm$^2$. In FIG. 6, the strips were treated in a bath containing 50 g/l of $CrO_3$, 0.69 g/l calculated as F of $NaBF_4$, and 2 g/l calculated as $SiO_2$ of Snowtex 0 in water by supplying electricity at a current density of 10 A/dm$^2$.

EXAMPLE 4

A zinc plated steel strip was subjected to electrolysis in a bath containing 50 g/l of $CrO_3$, 1.29 g/l calculated as F of $Na_2SiF_6$, and 6 g/l calculated as $SiO_2$ of Snowtex AK in water by supplying electricity at a current density of 10 A/dm$^2$ to a quantity of 10 C/dm$^2$. The resulting sample was subjected to a salt spray test (SST) according to JIS Z 2371 to determine the variation of percent white rust area with time.

In Comparative Example 4, a similar electrolytic chromate treatment was effected in a bath containing 50 g/l of $CrO_3$, 0.2 g/l of $H_2SO_4$, and 6 g/l calculated as $SiO_2$ of Snowtex AK in water by supplying electricity at a current density of 10 A/dm$^2$ to a quantity of 10 C/dm$^2$. The comparative sample was also examined for corrosion resistance by SST. Both the samples had a chromium coating weight of 100 mg/m$^2$.

Figure 7:
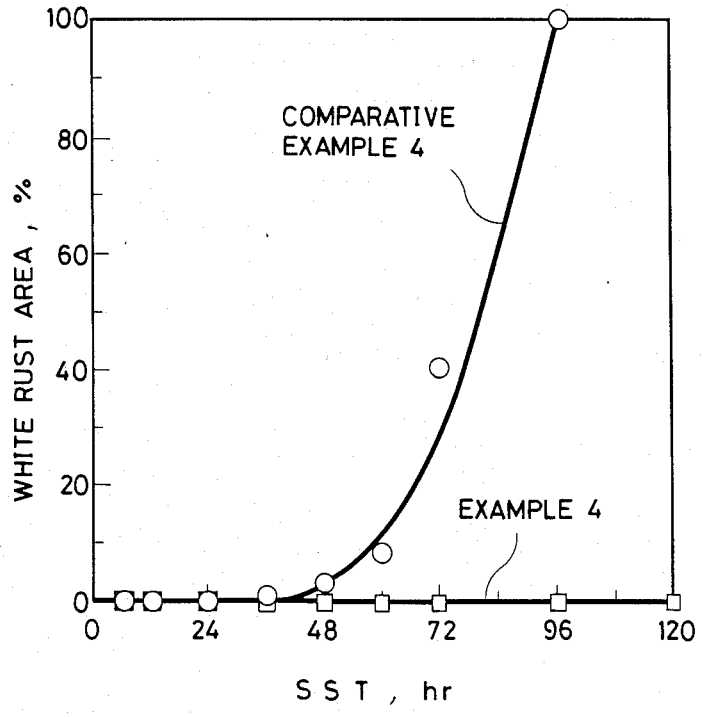
FIG. 7 is a diagram showing the percent white rust of chromate treated steel strips produced in Example 4 and Comparative Example 4 as a function of salt spray test time.

The results are shown in FIG. 7 in which the percent white rust area is plotted as a function of the time of SST. It is evident that the chromate film (Example 4) obtained by the present method has improved corrosion resistance over that (Comparative Example 4) obtained from the bath containing $Cr^{6+}$ plus cationic colloidal silica plus $H_2SO_4$ by the prior art method described in Japanese Patent Application Kokai No. 60-110896.

EXAMPLE 5

An electrogalvanized steel strip having a zinc coating weight of 20 g/m$^2$ was subjected to cathodic electrolysis in a bath containing 5 to 150 g/l of $CrO_3$, 0.05 to 5 g/l calculated as F of $Na_2SiF_6$, 0.5 to 50 g/l calculated as $SiO_2$ of colloidal silica, and 0 to 25 g/l calculated as $Al_2O_3$ of colloidal alumina in water by supplying electricity at a current density of 1 to 50 A/dm$^2$.

For comparison purposes, a reactive chromate treatment was carried out. In this comparative run designated Comparative Example R, the same electrogalvanized steel strip was treated in a commonly used reactive chromate bath containing 20 g/l of $CrO_3$ and 1 g/l of F, yielding a sample having a chromium coating weight of 40 mg/m$^2$.

Additionally, a coating chromate treatment was carried out. In this comparative run designated Comparative Example C, the same electrogalvanized steel strip was treated by applying an aqueous solution containing 30 g/l of $CrO_3$ and 80 g/l of colloidal silica and squeezing the coated strip between rolls to control the coating weight to 80 mg/m$^2$ of Cr.

Then an acrylic resin coating composition was applied to the thus obtained samples of this Example and Comparative Examples and baked at 160° C. for 20 minutes. The coated samples were subjected to several tests as described below. The results are shown in Table 1.

Test procedures and evaluation

(1) Corrosion resistance

A salt spray test (SST) was carried out according to JIS Z 2371, one cycle including salt water spraying for 8 hours and allowing to stand for 16 hours (total 24 hours). The sample was examined every cycle (24 hours) to determine the time taken until white rust appeared.

(2) Coating adherence

(2-1) Erichsen scribed adhesion test

The coated sample was scribed to define 100 square sections of 1 mm by 1 mm in the coating, cup drawn to a depth of 7 mm by means of an Erichsen drawing machine, and then examined for separation of coating sections by applying and removing an adhesive tape.

(2-2) duPont adhesion test

An impact was applied to the coated sample by dropping a ½ inch diameter weight of 500 grams from a height of 500 mm according to the duPont impact test. The sample was then examined for separation of coating pieces by applying and removing an adhesive tape.

(2-3) Immersion scribed adhesion test

The coated sample was immersed in boiling water for 3 hours, allowed to stand in air for 24 hours, scribed to define 100 square sections of 1 mm by 1 mm in the coating, and then examined for separation of coating sections by applying and removing an adhesive tape.

Evaluation was made according to the following criterion.

| Symbol | Observation |
|---|---|
| O | no separation |
| Δ | faintly separated |
| X | apparently separated |

(3) Adhesive bond

A polyvinyl chloride sheet was bonded to each of the samples of Example 5 and Comparative Examples R, C, using a thermosetting acrylic adhesive, SC-457 manufactured by Sony Chemical K.K. The sample was scribed to define 25 square sections of 2 mm by 2 mm down into the coating, cup drawn to a depth of 8 mm by means of an Erichsen drawing machine, and then visually examined for separation of coating.

Evaluation was made according to the following criterion.

| Symbol | Observation |
|---|---|
| O | no separation |
| Δ | faintly separated |
| X | apparently separated |

TABLE 1

| | Chromate film composition | | | | | Corrosion Resistance | Coating Adherence | | | | |
|---|---|---|---|---|---|---|---|---|---|---|---|
| Sample No. | Metallic Cr mg/m$^2$ | $Cr^{3+}$ mg/m$^2$ | $Cr^{6+}$ mg/m$^2$ | $SiO_2$ mg/m$^2$ | $Al_2O_3$ mg/m$^2$ | White rust time (hr.) | Erichsen adhesion | duPont adhesion | Immersion adhesion | Adhesive bond | Remarks |
| 1 | 10 | 60 | 10 | 15 | — | 144 | O | O | O | Δ | |
| 2 | 20 | 40 | 8 | 10 | — | 96 | O | O | O | O | |
| 3* | 30 | 15 | 5 | 5 | — | 48 | O | O | O | O | |
| 4* | 5 | 10 | 1 | 1 | — | 24 | O | O | O | O | |
| 5 | 5 | 15 | 2 | 2 | — | 48 | O | O | O | O | |
| 6 | 5 | 45 | 5 | 10 | — | 96 | O | O | O | O | |
| 7 | 5 | 90 | 20 | 15 | — | 192 | O | O | O | Δ | |
| 8 | 5 | 155 | 40 | 20 | — | 240 | O | Δ | O | Δ | |
| 9* | 5 | 200 | 50 | 30 | — | 240 | Δ | Δ | Δ | X | |
| 10* | 5 | 120 | 0.5 | 5 | — | 72 | O | O | O | Δ | |
| 11 | 5 | 120 | 1.5 | 5 | — | 120 | O | O | O | Δ | |
| 12 | 5 | 80 | 10 | 10 | — | 144 | O | O | O | Δ | |
| 13 | 5 | 40 | 3 | 15 | — | 96 | O | O | O | O | |
| 14* | 5 | 60 | 20 | 10 | — | 192 | Δ | Δ | Δ | Δ | irregularities observed |
| 15* | 5 | 70 | 5 | 1 | — | 72 | O | Δ | O | Δ | |
| 16 | 5 | 70 | 5 | 2 | — | 96 | O | O | O | Δ | |
| 17 | 5 | 70 | 5 | 15 | — | 144 | O | O | O | Δ | |
| 18 | 5 | 150 | 15 | 85 | — | 240 | O | Δ | O | Δ | |
| 19* | 5 | 150 | 15 | 100 | — | 240 | Δ | X | X | X | irregularities observed |
| 20 | 5 | 70 | 5 | 10 | 1 | 120 | O | O | O | O | |

TABLE 1-continued

| Sample No. | Chromate film composition: Metallic Cr mg/m² | $Cr^{3+}$ mg/m² | $Cr^{6+}$ mg/m² | $SiO_2$ mg/m² | $Al_2O_3$ mg/m² | Corrosion Resistance: White rust time (hr.) | Coating Adherence: Erichsen adhesion | duPont adhesion | Immersion adhesion | Adhesive bond | Remarks |
|---|---|---|---|---|---|---|---|---|---|---|---|
| 21 | 5 | 70 | 5 | 10 | 2 | 144 | O | O | O | O | |
| 22 | 5 | 70 | 5 | 10 | 5 | 144 | O | O | O | O | |
| 23* | 5 | 70 | 5 | 10 | 10 | 168 | O | O | O | O | irregularities observed |
| 24 | 5 | 80 | 5 | 20 | 2 | 144 | O | O | O | O | |
| 25 | 5 | 80 | 5 | 20 | 4 | 168 | O | O | O | O | |
| 26 | 5 | 80 | 5 | 20 | 10 | 192 | O | O | O | O | |
| 27* | 5 | 80 | 5 | 20 | 20 | 216 | O | O | O | O | irregularities observed |
| 28 | 5 | 150 | 20 | 50 | 5 | 210 | O | O | O | O | |
| 29 | 5 | 150 | 20 | 50 | 10 | 210 | O | O | O | O | |
| 30 | 5 | 150 | 20 | 50 | 20 | 240 | O | O | O | O | |
| 31* | 5 | 150 | 20 | 50 | 40 | 240 | O | O | O | O | irregularities observed |
| CE-R | | 40 | | — | — | 24 | O | O | O | Δ | reactive type |
| CE-C | | 80 | | 240 | — | 216 | X | X | X | X | coating type |

*samples falling outside the scope of the invention

According to the present invention, any desired amount of chromate film can be deposited on a variety of zinc-plated steel strips within a short time by subjecting the strips to a cathodic electrolytic treatment in a bath containing hexavalent chromium, an etching agent in the form of fluoride, and a film forming agent in the form of silicon dioxide. The resulting chromate-treated zinc-plated steel strip has a chromate film possessing excellent corrosion resistance and coating adherence. Such products cannot be produced by the conventional reactive, immersing or coating type chromate treatment methods. The present method can carry out a necessary electrolytic chromate treatment at a high speed and is convenient in controlling the amount of chromate film. Inclusion of aluminum oxide in the chromate film along with silicon dioxide further improves the adhesive bond of the chromate treated steel strip to a vinyl chloride or similar resin.

We claim:

1. A chromate-treated zinc-plated steel strip comprising a steel substrate, a zinc base plating on at least one surface of the substrate, a metallic chromium layer on the zinc base plating, a chromium oxide layer on the metallic chromium layer, consisting essentially of the oxide of trivalent chromium, and an outermost surface layer on the chromium oxide layer, consisting essentially of silicon dioxide and oxides of a major proportion of trivalent chromium and a proportion of hexavalent chromium and hydrates thereof which is effective to exert a self-healing effect on said layers.

2. A strip as claimed in claim 1, in which said effective proportion ranges from 1/100 to 1/5 of the total weight of chromium in the chromate film.

3. A chromate-treated zinc-plated steel strip comprising a steel substrate, a zinc base plating on at least one surface of the substrate, a metallic chromium layer on the zinc base plating, a chromium oxide layer on the metallic chromium layer, consisting essentially of the oxide of trivalent chromium, and an outermost surface layer on the chromium oxide layer, consisting essentially of silicon dioxide, aluminum oxide, and oxides of a major proportion of trivalent chromium and a proportion of hexavalent chromium and hydrates thereof which is effective to exert a self-healing effect on said layers.

4. A strip as claimed in claim 3, in which said effective proportion ranges from 1/100 to 1/5 of the total weight of chromium in the chromate film.

* * * * *